US010591190B2

(12) United States Patent
Yoshihiro et al.

(10) Patent No.: US 10,591,190 B2
(45) Date of Patent: Mar. 17, 2020

(54) RADIATIVE COOLING DEVICE

(71) Applicant: FUJIFILM CORPORATION, Minato-ku, Tokyo (JP)

(72) Inventors: Tatsuya Yoshihiro, Kanagawa (JP); Hideki Yasuda, Kanagawa (JP)

(73) Assignee: FUJIFILM CORPORATION, Tokyo (JP)

( * ) Notice: Subject to any disclaimer, the term of this patent is extended or adjusted under 35 U.S.C. 154(b) by 0 days.

(21) Appl. No.: 16/357,258

(22) Filed: Mar. 18, 2019

(65) Prior Publication Data

US 2019/0234658 A1 Aug. 1, 2019

Related U.S. Application Data

(63) Continuation of application No. PCT/JP2017/034212, filed on Sep. 22, 2017.

(30) Foreign Application Priority Data

Sep. 30, 2016 (JP) ..... 2016-194974

(51) Int. Cl.
*F25B 23/00* (2006.01)
*F25D 31/00* (2006.01)
*B65D 81/38* (2006.01)

(52) U.S. Cl.
CPC ..... *F25B 23/00* (2013.01); *F25D 31/00* (2013.01); *B65D 81/3823* (2013.01)

(58) Field of Classification Search
USPC ..... 250/495.1, 505.1
See application file for complete search history.

(56) References Cited

U.S. PATENT DOCUMENTS

2005/0167612 A1 8/2005 Jaffer
2010/0155043 A1 6/2010 Smith
(Continued)

FOREIGN PATENT DOCUMENTS

CN 105972856 A 9/2016
JP S54-139150 A 10/1979
(Continued)

OTHER PUBLICATIONS

International Search Report issued in International Application No. PCT/JP2017/034212 dated Dec. 12, 2017.
(Continued)

*Primary Examiner* — Kiet T Nguyen
(74) *Attorney, Agent, or Firm* — SOLARIS Intellectual Property Group, PLLC

(57) ABSTRACT

A radiative cooling device including: a heat insulating container having an opening portion, and being configured to house an object to be cooled at an interior thereof and thermally insulates the object from an exterior thereof; a far-infrared radiator that is arranged between the object and the opening portion in the heat insulating container, that thermally contacts the object, and that radiates far-infrared rays in a wavelength range of from 8 μm to 13 μm; a far-infrared transmitting window member that closes at least part of the opening portion of the heat insulating container and that transmits the far-infrared rays radiated from the far-infrared radiator; and an intermediate heat insulating member that is arranged between the far-infrared transmitting window member and the far-infrared radiator, that thermally insulates the far-infrared transmitting window member and the far-infrared radiator from each other, and that transmits the far-infrared rays radiated from the far-infrared radiator.

14 Claims, 3 Drawing Sheets

(56) References Cited

U.S. PATENT DOCUMENTS

| | | | | |
|---|---|---|---|---|
| 2015/0338175 | A1 | 11/2015 | Raman et al. | |
| 2015/0366079 | A1* | 12/2015 | Matsuda | B23K 1/008 219/72 |
| 2019/0257557 | A1* | 8/2019 | Yoshizawa | F28F 9/20 |

FOREIGN PATENT DOCUMENTS

| | | | |
|---|---|---|---|
| JP | S58-083168 | A | 5/1983 |
| JP | S60-062515 | A | 4/1985 |
| JP | S61-029664 | A | 2/1986 |
| JP | S61-223468 | A | 10/1986 |
| JP | 2016-121328 | A | 7/2016 |
| JP | 2016-188715 | A | 11/2016 |
| JP | 2017-062055 | A | 3/2017 |

OTHER PUBLICATIONS

Written Opinion of the ISA issued in International Application No. PCT/JP2017/034212 dated Dec. 12, 2017.

English language translation of the following: Office action dated Jul. 23, 2019 from the JPO in a Japanese patent application No. 2018-542503 corresponding to the instant patent application.

* cited by examiner

RADIATIVE COOLING DEVICE

CROSS-REFERENCE TO RELATED APPLICATIONS

This application is a continuation application of International Application No. PCT/JP2017/034212, filed Sep. 22, 2017, the disclosure of which is incorporated herein by reference in its entirety. Further, this application claims priority from Japanese Patent Application No. 2016-194974, filed Sep. 30, 2016, the disclosure of which is incorporated herein by reference in its entirety.

BACKGROUND OF THE INVENTION

1. Field of the Invention

The present disclosure relates to a radiative cooling device.

2. Description of the Related Art

Radiative cooling is a well-known natural phenomenon.

In recent years, a radiative cooling device using radiative cooling is being studied in a viewpoint of energy savings and so forth.

For example, there is known a radiative cooling device including a heat insulating container to which an object to be cooled is introduced and that thermally insulates, except part of the heat insulating container, the object from the outside, and a heat radiator having a specific structure that covers an exposed portion of the heat insulating container (for example, see JP1983-83168A (JP-558-83168A)).

In addition, there is known a radiative cooling device for cooling an object to be cooled, the radiative cooling device including a plurality of different materials arranged in a depth direction thereof with respect to the object, the plurality of different materials including a solar-spectrum reflecting portion and a heat radiator (for example, see the specification of US2015/0338175A).

In addition, there is known a radiative cooling device consisting of a heat insulating container whose one surface has an opening, a light transmitting plate that covers the opening of the heat insulating container, a heat radiator provided inside the light transmitting plate so as to cover the opening, and an inlet and outlet portion through which an object to be cooled is inserted to and removed from the inside of the heat radiator (for example, see JP1986-223468A (JP-561-223468A)). The light transmitting plate is formed of a crystal body of TlBr.Tl1, or a plate body consisting of an $As_2Se_3$-based glass or a $Ge_{33}Ad_{12}Se_{55}$-based glass having high infrared transmissivity. The heat radiator contacts the object, and is formed of a metal plate having high reflectance and high heat conductance and a coating that coats the metal plate and that consists of $TiO_2$ having high reflectance for solar rays and high emittance for infrared rays.

SUMMARY OF THE INVENTION

However, with the technology described in JP1983-83168A (JP-S58-83168A), since the heat radiator contacts the atmosphere, heat inflow from the atmosphere into the heat radiator may cause an increase in the attainable temperature at cooling.

In addition, with the technology described in the specification of US2015/0338175A, heat conduction from the solar-spectrum reflecting portion to the heat radiator may cause an increase in the attainable temperature at cooling.

Furthermore, with the technology described in JP1986-223468A (JP-561-223468A), heat conduction from the light transmitting plate that covers the opening to the heat radiator may cause an increase in the attainable temperature at cooling.

An object of an aspect of the present disclosure is to provide a radiative cooling device having a low attainable temperature at cooling.

Means for attaining the object includes the following aspect.

<1> A radiative cooling device comprising:

a heat insulating container that has an opening portion, and that is configured to house an object to be cooled at an interior thereof and thermally insulates the object from an exterior thereof;

a far-infrared radiator that is arranged between the object and the opening portion in the heat insulating container, that thermally contacts the object, and that radiates far-infrared rays in a wavelength range of from 8 μm to 13 μm;

a far-infrared transmitting window member that closes at least a part of the opening portion of the heat insulating container and that transmits the far-infrared rays radiated from the far-infrared radiator; and an intermediate heat insulating member that is arranged between the far-infrared transmitting window member and the far-infrared radiator, that thermally insulates the far-infrared transmitting window member and the far-infrared radiator from each other, and that transmits the far-infrared rays radiated from the far-infrared radiator.

<2> The radiative cooling device according to <1>, wherein the far-infrared radiator has an average emittance $E_{8\text{-}13}$ in the wavelength range, in a radiation direction of the far-infrared rays, of 0.80 or more, and wherein the far-infrared transmitting window member has an average transmittance $T_{8\text{-}13}$ in the wavelength range, in a transmission direction of the far-infrared rays, of 0.40 or more.

<3> The radiative cooling device according to <1> or <2>, wherein the intermediate heat insulating member has an average transmittance $T_{8\text{-}13}$ in the wavelength range, in a transmission direction of the far-infrared rays, of 0.50 or more.

<4> The radiative cooling device according to any one of <1> to <3>, wherein the intermediate heat insulating member contains a resin.

<5> The radiative cooling device according to <4>, wherein the resin includes gas cells.

<6> The radiative cooling device according to <5>, wherein the intermediate heat insulating member has a void volume of 70% or more.

<7> The radiative cooling device according to <5> or <6>, wherein, in a cross section of the intermediate heat insulating member cut along a transmission direction of the far-infrared rays, a number of gas cells across which a straight line in the transmission direction extends is 7 or less.

<8> The radiative cooling device according to any one of <4> to <7>, wherein the resin is at least one selected from the group consisting of polyethylene, polypropylene, polycarbonate, polystyrene, and polynorbornene.

<9> The radiative cooling device according to any one of <1> to <8>, wherein the intermediate heat insulating member has a heat conductance, in a transmission direction of the far-infrared rays, of 0.08 W/(m·K) or less.

<10> The radiative cooling device according to any one of <1> to <9>, wherein the far-infrared transmitting window member includes a window-member main body, and a solar-ray reflecting layer that is arranged on a side opposite from a side of the far-infrared radiator when viewed from the window-member main body and that reflects solar rays.

<11> The radiative cooling device according to <10>, wherein the solar-ray reflecting layer includes particles having a number-average particle diameter of from 0.1 μm to 20 μm.

<12> The radiative cooling device according to any one of <1> to <11>, wherein the far-infrared transmitting window member has, at a surface thereof on a side opposite from a surface thereof on a side of the far-infrared radiator, a solar-radiation reflectance of 80% or more.

<13> The radiative cooling device according to any one of <1> to <12>, further comprising a metal cylindrical member that is arranged on a side opposite from a side of the far-infrared radiator when viewed from the far-infrared transmitting window member and through which the far-infrared rays transmitted through the far-infrared transmitting window member pass.

With the aspect of the present invention, a radiative cooling device having a low attainable temperature at cooling is provided.

DESCRIPTION OF THE PREFERRED EMBODIMENTS

Figure 1:
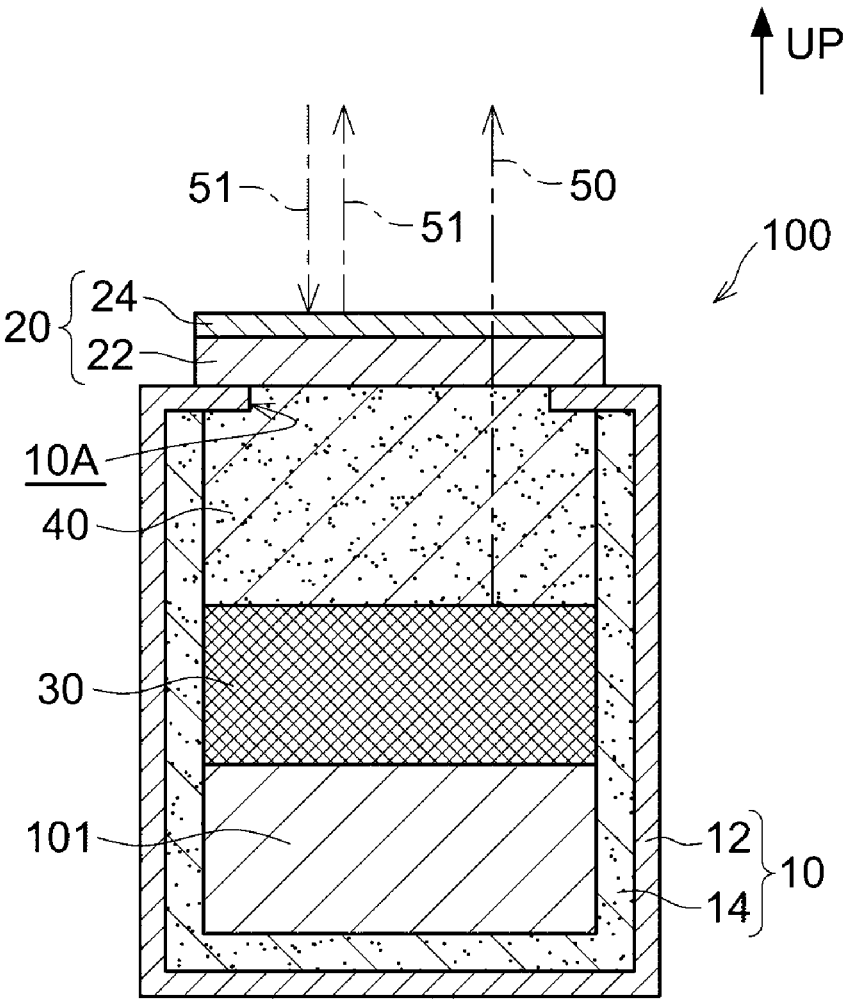
FIG. 1 is a schematic cross-sectional view conceptually showing a radiative cooling device that is an example of a radiative cooling device of the present disclosure.

In this specification, a numerical-value range expressed using sign "-" represents a range including numerical values written before and after "-" as the lower limit value and the upper limit value.

In this specification, when a plurality of substances corresponding to a component exist in a composition, the amount of the component in the composition represents the total amount of the plurality of substances existing in the composition unless otherwise noted.

In this specification, "far-infrared rays" without limitation of the wavelength range represent electromagnetic waves in a wavelength range of 5 μm-25 μm, and "far-infrared rays in a wavelength range of 8 μm-13 μm" represent far-infrared rays in a wavelength range of 8 μm-13 μm included in the above-described far-infrared rays.

A radiative cooling device of the present disclosure includes a heat insulating container that has an opening portion, and that is configured to house an object to be cooled at an interior thereof and thermally insulates the object from an exterior thereof;

a far-infrared radiator that is arranged between the object and the opening portion in the heat insulating container, that thermally contacts the object, and that radiates far-infrared rays in a wavelength range of 8 μm-13 μm (hereinafter, also referred to as "specific far-infrared rays");

a far-infrared transmitting window member that closes at least part of the opening portion of the heat insulating container and that transmits the specific far-infrared rays radiated from the far-infrared radiator; and an intermediate heat insulating member that is arranged between the far-infrared transmitting window member and the far-infrared radiator, that thermally insulates the far-infrared transmitting window member and the far-infrared radiator from each other, and that transmits the specific far-infrared rays radiated from the far-infrared radiator.

With the radiative cooling device of the present disclosure, an advantageous effect that the attainable temperature at cooling is lower than a case without the intermediate heat insulating member. The advantageous effect can be attained during both the daytime and the nighttime.

The reason that the advantageous effect is attained is expected as follows.

When the object is housed in the heat insulating container of the object device of the present disclosure, the specific far-infrared rays (that is, the far-infrared rays in the wavelength range of 8 μm-13 μm) are radiated from the far-infrared radiator that thermally contacts the object. The wavelength range (8 μm-13 μm) of the specific far-infrared rays is a wavelength range called "atmospheric window", and is a wavelength range with high transmittance for electromagnetic waves that are transmitted through the atmosphere. Thus, the specific far-infrared rays radiated from the far-infrared radiator that thermally contacts the object are transmitted through the intermediate heat insulating member and the far-infrared transmitting window member in that order, then are transmitted through the atmosphere without being absorbed by the atmosphere, and reach the sky (that is, the space). Consequently, the object is cooled by a radiative cooling phenomenon.

In the radiative cooling device of the present disclosure, the far-infrared radiator is housed in the heat insulating container, and the intermediate heat insulating member is arranged between the far-infrared transmitting window member and the far-infrared radiator.

Since the far-infrared radiator is arranged in the heat insulating container, heat inflow from the atmosphere (that is, the outside of the radiative cooling device) into the far-infrared radiator is suppressed, and consequently, heat inflow into the object is also suppressed.

Further, since the intermediate heat insulating member is arranged between the far-infrared transmitting window member and the far-infrared radiator, heat conduction from the far-infrared transmitting window member to the far-infrared radiator is suppressed, and consequently, heat conduction to the object is also suppressed.

With the radiative cooling device of the present disclosure, an increase in the attainable temperature at cooling caused by the above-described heat inflow and heat conduction is suppressed, and consequently, the attainable temperature at cooling is lower than the case without the intermediate heat insulating member.

An example of a radiative cooling device of the present disclosure is described below with reference to the drawings. It is to be noted that the radiative cooling device of the present disclosure is not limited to the example described below.

In the drawings, the same reference sign is applied to the members having substantially the same function, and the redundant description may be omitted in the specification.

FIG. 1 is a schematic cross-sectional view conceptually showing a state in which a radiative cooling device that is the example of the radiative cooling device of the present disclosure houses an object to be cooled in a heat insulating container and is arranged outdoors such that an opening portion of the heat insulating container faces upward (in a direction indicated by arrow UP in FIG. 1, in a direction of the sky).

As shown in FIG. 1, a radiative cooling device 100 includes a heat insulating container 10.

The heat insulating container 10 is a member that houses an object to be cooled 101 at an interior thereof and that thermally insulates the object 101 from the exterior thereof. The heat insulating container 10 is formed of a container main body 12, and a container heat insulating member 14 arranged along an inner surface of the container main body 12. That is, the heat insulating container 10 is a composite member of the container main body 12 and the container heat insulating member 14. At least the container heat insulating member 14 of the container main body 12 and the container heat insulating member 14 includes a heat insulating material. The container main body 12 may include a heat insulating material or may not include a heat insulating material.

It is to be noted that the heat insulating container according to the present disclosure is not limited to being the composite member, and may be a single member including a heat insulating material. When the heat insulating container is the composite member, the container heat insulating member does not have to be arranged along the entire inner surface of the container main body, and may be arranged at at least part of the inner surface.

The heat insulating container 10 has, in an upper surface thereof, an opening portion 10A.

The radiative cooling device 100 includes a far-infrared radiator 30 in the heat insulating container 10. The far-infrared radiator 30 radiates specific far-infrared rays 50.

In the state (the state in FIG. 1) in which the object 101 is housed in the heat insulating container 10, the far-infrared radiator 30 is arranged between the object 101 and the opening portion 10A and thermally contacts the object 101.

In this case, a situation in which the far-infrared radiator 30 thermally contacts the object 101 represents a situation in which the far-infrared radiator 30 contacts the object 101 directly or via a heat conductive member (for example, metal member).

The far-infrared radiator 30 does not have to be fixedly arranged in the heat insulating container 10. For example, after the object 101 is housed in the heat insulating container 10, the far-infrared radiator 30 may be placed on the object 101 directly or via a heat conductive member.

The radiative cooling device 100 includes a far-infrared transmitting window member 20 that closes the opening portion 10A of the heat insulating container 10.

While the far-infrared transmitting window member 20 is a member that covers the entire opening portion 10A of the heat insulating container 10, a far-infrared transmitting window member is not limited to the aspect of the far-infrared transmitting window member 20. For example, a far-infrared transmitting window member may be a member that covers part of an opening portion of a heat insulating container, or a member that is fitted into part or the entirety of an opening portion of a heat insulating container. In short, the far-infrared transmitting window member may be any member as long as the member closes at least part of the opening portion of the heat insulating container.

In this example, the far-infrared transmitting window member 20 is a composite member having a multilayer structure in which a window-member main body 22 and a solar-ray reflecting layer 24 are stacked. The solar-ray reflecting layer 24 is arranged on an upper side of the window-member main body 22 (that is, a side opposite from a side of the far-infrared radiator 30 when viewed from the window-member main body 22). The solar-ray reflecting layer 24 has a function of reflecting solar rays 51 (that is, electromagnetic waves in a wavelength range of 2.5 μm or less).

The far-infrared transmitting window member 20, as a whole, has a function of transmitting the specific far-infrared rays 50 radiated from the far-infrared radiator 30.

Alternatively, in this example, a far-infrared transmitting window member that is a single member having both a specific-far-infrared transmitting function and a solar-ray reflecting function may be used instead of the far-infrared transmitting window member 20 that is a composite member.

The radiative cooling device 100 includes an intermediate heat insulating member 40 between the far-infrared transmitting window member 20 and the far-infrared radiator 30 in the heat insulating container 10.

The intermediate heat insulating member 40 is a member that thermally insulates the far-infrared transmitting window member 20 and the far-infrared radiator 30 from each other, and is a member that transmits the specific far-infrared rays 50 radiated from the far-infrared radiator 30.

The heat insulating material of the intermediate heat insulating member 40 may be the same as or different from the heat insulating material of the above-described container heat insulating member 14. The heat insulating material is described later.

In this specification, a term "intermediate heat insulating member" is for distinguishing the term from another term "container heat insulating member".

"Intermediate" represents location between the far-infrared transmitting window member and the far-infrared radiator.

In this specification, "heat insulation" represents suppressing heat conduction, and a specific heat conductance is not particularly limited. The heat conductance of "heat insulation" in the present disclosure is preferably less than 0.1 W/(m·K), or more preferably equal to or less than 0.08 W/(m·K).

Cooling of an object to be cooled using the radiative cooling device 100 is described below.

In the radiative cooling device 100, the specific far-infrared rays 50 radiated from the far-infrared radiator 30, which thermally contacts the object 101, are transmitted through the intermediate heat insulating member 40 and the far-infrared transmitting window member 20 in that order and dissipated to the exterior of the radiative cooling device 100. The specific far-infrared rays 50 dissipated to the exterior of the radiative cooling device 100 are transmitted through the atmosphere without being absorbed by the atmosphere, and reach the sky (that is, the space). Consequently, the object 101 is cooled by a radiative cooling phenomenon.

In the radiative cooling device 100, the far-infrared radiator 30 is housed in the heat insulating container 10. Thus, heat inflow from the exterior of the device into the far-infrared radiator 30 is suppressed, and consequently, heat inflow into the object 101 is also suppressed.

In addition, in the radiative cooling device 100, the far-infrared transmitting window member 20 and the far-infrared radiator 30 are thermally insulated from each other by the intermediate heat insulating member 40. Thus, heat conduction from the far-infrared transmitting window member 20 to the far-infrared radiator 30 is suppressed, and consequently, heat conduction to the object 101 is also suppressed.

In the radiative cooling device 100, since the above-described heat inflow and heat conduction are suppressed at cooling of the object, the attainable temperature can be decreased.

Further, since the radiative cooling device 100 uses the far-infrared transmitting window member 20 including the solar-ray reflecting layer 24 that reflects the solar rays 51 as the far-infrared transmitting window member, an increase in the attainable temperature caused by heat of the solar rays 51 is suppressed.

Alternatively, in the radiative cooling device 100, a far-infrared transmitting window member that is a single member having both the specific-far-infrared transmitting function and the solar-ray reflecting function may be used instead of the far-infrared transmitting window member 20 that is a composite member. Even in this case, an advantageous effect similar to that in the case using the far-infrared transmitting window member 20 being the composite member is attained.

In FIG. 1, regarding the arrangement angle of the entire radiative cooling device 100, while the opening portion 10A of the heat insulating container 10 faces directly upward (that is, in a direction opposite to the direction of gravity), the arrangement angle of the entire radiative cooling device 100 is not limited to the angle. The arrangement angle of the entire radiative cooling device 100 may be arrangement in which an opening portion of a heat insulating container faces obliquely upward. In short, the arrangement angle of the entire radiative cooling device 100 may be any angle as long as the angle allows the specific far-infrared rays 50 radiated from the far-infrared radiator 30 to be radiated toward the sky via the intermediate heat insulating member 40 and the far-infrared transmitting window member 20. The arrangement angle of the entire radiative cooling device 100 may be an arrangement angle at which an opening portion of a heat insulating container faces a direction that differs from the direction of the sun in a viewpoint of suppressing heat inflow due to the solar rays.

Next, preferable aspects of an object to be cooled and a radiative cooling device according to the present disclosure are described.

Cooling Object

An object to be cooled (for example, cooling object 101) according to the present disclosure is not particularly limited as long as the object can be housed in a heat insulating container.

The object may be a solid, liquid, or gas with regard to the principle of the radiative cooling device of the present disclosure.

In a viewpoint of practical use, the object is preferably at least one of a solid or liquid.

If the object is liquid, a container that houses the liquid as the object may be housed in a heat insulating container (see examples (described later)).

Heat Insulating Container

The radiative cooling device of the present disclosure includes a heat insulating container (for example, the above-described heat insulating container 10).

The heat insulating container is a container that houses an object to be cooled in the heat insulating container and that thermally insulates the housed cooling object from the exterior of the heat insulating container.

The heat insulating container may have any configuration as long as the configuration exhibits the above-described function, and the specific configuration is not particularly limited.

The heat insulating container may be a heat insulating container (for example, the above-described heat insulating container 10) that is a composite member of a container main body (for example, the above-described container main body 12) and a container heat insulating member (for example, the above-described container heat insulating member 14), a composite member in which a heat insulating material is coated with a metal film or the like, or may be a heat insulating container that is a single member consisting of a heat insulating material.

A preferable aspect of the heat insulating material included in the container heat insulating member is similar to a preferable aspect of the heat insulating material included in an intermediate heat insulating member (described later).

The material of the container main body of the heat insulating container is not particularly limited.

The material of the container body is preferably a metal material or an inorganic material other than the metal material.

The metal material may be metal, such as copper, silver, or aluminum; or an alloy, such as stainless steel or an aluminum alloy.

The inorganic material other than the metal material may be glass, such as soda glass, potash glass, or lead glass; ceramics such as PLZT (lead lanthanum zirconate titanate); quartz; fluorite; or sapphire.

The material of the container body is preferably a metal material having high performance of reflecting solar rays which are a main heat inflow source or radiant heat, or more preferably aluminum, silver, an aluminum alloy, or stainless steel, in a viewpoint of suppressing heat inflow from the exterior thereof.

The material of the container body may be a material in which an inorganic material other than a metal material is coated with a metal material.

The thickness of the heat insulating container can be appropriately set with regard to the strength and the degree of heat insulation of the heat insulating container.

In addition, the heat insulating container has an opening portion (for example, the above-described opening portion 10A and an opening portion 110A (described later)).

The opening portion of the heat insulating container functions as an outlet of specific far-infrared rays radiated from a far-infrared radiator.

The specific far-infrared rays dissipated to the exterior of the heat insulating container via the opening portion are transmitted through a far-infrared transmitting window member, are further transmitted through the atmosphere, and reach the sky.

The shape in plan view of the opening portion may be an elliptic shape (including a circular shape), a rectangular shape (including a square shape), or a polygonal shape other than the rectangular shape. The shape in plan view of the opening portion may be an indeterminate shape other than the above-listed shapes.

The shape in plan view of the opening portion may be preferably an elliptic shape, or more preferably a circular shape in a viewpoint of easy working.

The opening portion of the heat insulating container may have a function as an outlet and inlet for an object to be cooled.

Alternatively, the heat insulating container may have an outlet and inlet for an object to be cooled in addition to the opening portion.

The heat insulating container may be configured to allow an object to be cooled to be inserted into the heat insulating container and to be removed from the heat insulating container. With this configuration, an object to be cooled may not be housed in the heat insulating container except when the object is cooled.

In other words, the heat insulating container has an object to be cooled housing portion. An object to be cooled may be removably housed in the object housing portion or may be fixed at the object housing portion. Such an object to be cooled housing portion may be a space including a certain support structure in a peripheral portion of the space. For example, the object housing portion may be an inner space of a certain container.

In this viewpoint, a radiative cooling device according to an embodiment is provided, the radiative cooling device including a heat insulating container that has an opening portion, that includes at an interior thereof an object to be cooled housing portion, and that thermally insulates the object housing portion from an exterior thereof;

a far-infrared radiator that is arranged between the object housing portion and the opening portion in the heat insulating container, that thermally contacts the object housing portion, and that radiates far-infrared rays in a wavelength range of 8 μm-13 μm;

a far-infrared transmitting window member that closes at least part of the opening portion of the heat insulating container and that transmits the far-infrared rays radiated from the far-infrared radiator; and an intermediate heat insulating member that is arranged between the far-infrared transmitting window member and the far-infrared radiator, that thermally insulates the far-infrared transmitting window member and the far-infrared radiator from each other, and that transmits the far-infrared rays radiated from the far-infrared radiator.

With such a radiative cooling device, by arranging an object to be cooled in the object housing portion, the radiative cooling device can be used for cooling the object. Therefore, a use of the radiative cooling device for cooling an object to be cooled is also provided.

In addition, a cooling kit is provided, the cooling kit including a heat insulating container that has an opening portion, that includes at an interior thereof an object to be cooled housing portion, and that thermally insulates the object housing portion from an exterior thereof;

a far-infrared radiator that radiates far-infrared rays in a wavelength range of 8 μm-13 μm;

a far-infrared transmitting window member that transmits the far-infrared rays radiated from the far-infrared radiator when arranged to close at least part of the opening portion of the heat insulating container;

an intermediate heat insulating member that thermally insulates the far-infrared transmitting window member and the far-infrared radiator from each other and that transmits the far-infrared rays radiated from the far-infrared radiator when arranged between the far-infrared transmitting window member and the far-infrared radiator; and an instruction that describes a process of cooling an object to be cooled by arranging the object in the object housing portion, arranging the far-infrared radiator between the object and the opening portion in the heat insulating container so as to thermally contact the object, arranging the intermediate heat insulating member between the far-infrared transmitting window member and the far-infrared radiator, and closing at least part of the opening portion of the heat insulating container using the far-infrared transmitting window member.

Further, a use of the cooling kit for cooling an object to be cooled is also provided.

The sizes of the heat insulating container and the opening portion are not particularly limited, and may be appropriately set depending on the purpose.

The height of the heat insulating container (that is, the length of the heat insulating container in a radiation direction in which the specific far-infrared rays are radiated from the far-infrared radiator) is, for example, 10 mm-2 m, preferably 10 mm-500 mm, or more preferably 100 mm-300 mm.

The maximum length of the heat insulating container (that is, the maximum length in a direction orthogonal to the height direction; for example, the diameter when the heat insulating container has a columnar shape) is, for example, 10 mm-30 m, preferably 10 mm-1000 mm, or more preferably 100 mm-500 mm.

The maximum length of the opening portion of the heat insulating container (that is, the diameter when the opening portion has a circular shape) is, for example, 10 mm-30 m, preferably 10 mm-1000 mm, or more preferably 50 mm-210 mm. Further, a single heat insulating container may be provided with a plurality of opening portions.

Far-Infrared Radiator

The radiative cooling device of the present disclosure includes a far-infrared radiator (for example, the above-described far-infrared radiator 30) that radiates specific far-infrared rays in the heat insulating container.

When an object to be cooled is housed in the heat insulating container, the far-infrared radiator is arranged between the object and the opening portion of the heat insulating container and thermally contacts the object.

The position of the far-infrared radiator in the heat insulating container is preferably a position at which at least part of the opening portion overlaps at least part of the far-infrared radiator, or more preferably a position at which the entirety of the opening portion overlaps at least part of the far-infrared radiator, in plan view of the opening portion of the heat insulating container from the exterior of the heat insulating container.

The structure of the far-infrared radiator may be a single-layer structure consisting of a radiator main body, or may be a multilayer structure including the radiator main body and another layer (for example, a radiator reflecting layer (described later)).

Average Emittance $E_{8-13}$ in Wavelength Range of 8 μm-13 μm.

The far-infrared radiator has an average emittance $E_{8-13}$ in a wavelength range of 8 μm-13 μm in a radiation direction of the specific far-infrared rays, the average emittance $E_{8-13}$ being preferably 0.80 or more, more preferably 0.85 or more, or particularly preferably 0.90 or more. If the average emittance $E_{8-13}$ of the far-infrared radiator is 0.80 or more, the radiation performance of the specific far-infrared rays of the far-infrared radiator is further improved, and hence the attainable temperature at cooling can be further decreased.

The upper limit of the average emittance $E_{8-13}$ of the far-infrared transmitting window member is not particularly limited. The average emittance $E_{8-13}$ of the far-infrared transmitting window member is preferably 0.98 or less in a viewpoint of suitability for manufacturing of the far-infrared transmitting window member.

Figure 3:
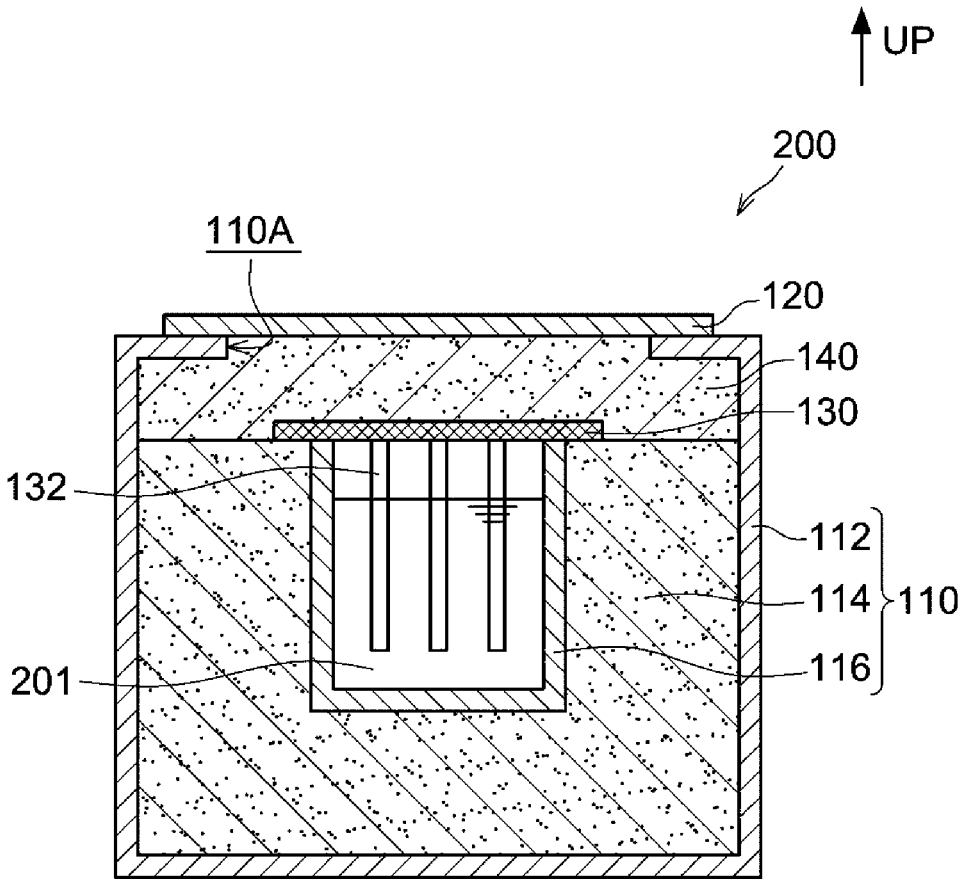
FIG. 3 is a schematic cross-sectional view conceptually showing a radiative cooling device of Example 1 of the present disclosure.

The radiation direction of the specific far-infrared rays is a direction in which the specific far-infrared rays radiated from the far-infrared radiator are dissipated to the outside from the heat insulating container via a far-infrared transmitting window member, and is, for example, a direction indicated as a traveling direction of the specific far-infrared rays 50 in FIGS. 1 and 3.

In this specification, when the far-infrared radiator has a multilayer structure, the preferable spectral characteristics (average emittance) of the far-infrared radiator represent the spectral characteristics of the entire far-infrared radiator (that is, the entire multilayer structure).

In this specification, the average emittance $E_{8-13}$ represents an arithmetic mean value of spectral emittances obtained from spectral transmittances and spectral reflectances according to the Kirchhoff theory for wavelengths (10 wavelengths described below) included in a wavelength range of 8 μm-13 μm in Appendix Table 3 in JIS R 3106:1998.

The average emittance in the wavelength range of 8 μm-13 μm is specifically obtained as follows.

First, spectral transmittances and spectral reflectances in a wavelength range of 1.7 μm-25 μm are measured by using a Fourier transform infrared spectrometer (FTIR).

Among the measurement results of the spectral transmittances and spectral reflectances in the wavelength range of 1.7 μm-25 μm, a spectral emittance is calculated according to the Kirchhoff theory written below for each of the wavelengths included in the wavelength range of 8 μm-13 μm (more specifically, 10 wavelengths of 8.1 μm, 8.6 μm, 9.2 μm, 9.7 μm, 10.2 μm, 10.7 μm, 11.3 μm, 11.8 μm, 12.4 μm, and 12.9 μm) in Appendix Table 3 in JIS R 3106:1998.

Kirchhoff theory: spectral emittance=1−spectral transmittance−spectral reflectance By arithmetically averaging the spectral emittances of the respective wavelengths (10 values), "the average emittance in the wavelength range of 8 μm-13 μm" is obtained.

In an example (described later), for the FTIR device, a FTIR (model No. FTS-7000) manufactured by Varian, Inc. was used.

$E_{8-13}/E_{5-25}$ Ratio

The far-infrared radiator preferably radiates the specific far-infrared rays with priority (or ideally, selectively) in the radiation direction of the specific far-infrared rays.

More specifically, an $E_{8-13}/E_{5-25}$ ratio that is a ratio of the average emittance $E_{8-13}$ of the far-infrared radiator to an average emittance $E_{5-25}$ of the far-infrared radiator in a wavelength range of 5 μm-25 μm in the radiation direction of the specific far-infrared rays is preferably 1.20 or more, more preferably 1.30 or more, or particularly preferably 1.50 or more.

If the $E_{8-13}/E_{5-25}$ ratio of the far-infrared radiator is 1.20 or more, the specific far-infrared rays can be radiated from the far-infrared radiator while heat inflow to the far-infrared radiator due to heat radiation of the atmosphere (that is, heat radiation caused by electromagnetic waves with wavelengths of less than 8 μm and electromagnetic waves with wavelengths of more than 13 μm) is suppressed. Thus, the attainable temperature at cooling can be further decreased.

The upper limit of the $E_{8-13}/E_{5-25}$ ratio is not particularly limited. The upper limit of the $E_{8-13}/E_{5-25}$ ratio is preferably 2.40 or less in a viewpoint of suitability for manufacturing of the far-infrared radiator.

In this specification, the average emittance $E_{5-25}$ represents an arithmetic mean value of spectral emittances for wavelengths included in a wavelength range of 5 μm-25 μm in Appendix Table 3 in JIS R 3106:1998.

The average emittance $E_{5-25}$ is specifically obtained as follows.

First, spectral transmittances and spectral reflectances in a wavelength range of 1.7 μm-25 μm are measured by using a Fourier transform infrared spectrometer (FTIR).

Among the measurement results of the spectral transmittances and spectral reflectances in the wavelength range of 1.7 μm-25 μm, the spectral emittance is calculated according to the Kirchhoff theory written above for each of the wavelengths included in the wavelength range of 5 μm-25 μm (more specifically, 24 wavelengths of 5.5 μm, 6.7 μm, 7.4 μm, 8.1 μm, 8.6 μm, 9.2 μm, 9.7 μm, 10.2 μm, 10.7 μm, 11.3 μm, 11.8 μm, 12.4 μm, 12.9 μm, 13.5 μm, 14.2 μm, 14.8 μm, 15.6 μm, 16.3 μm, 17.2 μm, 18.1 μm, 19.2 μm, 20.3 μm, 21.7 μm, and 23.3 μm) in Appendix Table 3 in JIS R 3106:1998.

By arithmetically averaging the spectral emittances of the respective wavelengths (24 values), the average emittance $E_{5-25}$ is obtained.

Average Reflectance $R_{3-7}$ in Wavelength Range of 3 μm-7 μm

The far-infrared radiator has, at a surface thereof on a side of a far-infrared transmitting window member, an average reflectance $R_{3-7}$ in a wavelength range of 3 μm-7 μm, the average reflectance $R_{3-7}$ being preferably 0.05 or more, or more preferably 0.10 or more. If the average reflectance $R_{3-7}$ of the far-infrared transmitting window member is 0.10 or more, incidence of electromagnetic waves in the wavelength range of 3 μm-7 μm from an upper side to the far-infrared radiator and the object (a direction of the far-infrared transmitting window member when viewed from the far-infrared radiator) can be suppressed, and hence an increase in the attainable temperature due to the incidence of the electromagnetic waves can be further suppressed.

The average reflectance $R_{3-7}$ being 0.05 or more can be easily attained when the far-infrared radiator includes a radiator reflecting layer (described later).

The upper limit of the average reflectance $R_{3-7}$ of the far-infrared transmitting window member is not particularly limited. The average reflectance $R_{3-7}$ of the far-infrared transmitting window member is preferably 0.90 or less (or more preferably 0.80 or less) in a viewpoint of suitability for manufacturing of the far-infrared transmitting window member.

In this specification, the average reflectance $R_{3-7}$ represents an arithmetic mean value of spectral reflectances for wavelengths included in a wavelength range of 3 μm-7 μm in Appendix Table 3 in JIS R 3106:1998.

The measurement method of the average reflectance $R_{3-7}$ is similar to the measurement method of the average emittance $E_{8-13}$ (described above) except that the spectral reflectances are measured for the wavelengths included in the wavelength range of 3 μm-7 μm in Appendix Table 3 in JIS R 3106:1998 and the arithmetic mean value of the measurement results is obtained.

Materials and Shapes

The far-infrared radiator (radiator main body) can appropriately select and use a substance that radiates specific far-infrared rays from known heat radiators, and is not particularly limited.

The far-infrared radiator (radiator main body) is preferably a blackbody radiator or a radiator including a multilayer film of a titania film and a silica film in a viewpoint of high average emittance in a wavelength range of 8 μm-13 μm.

The far-infrared radiator (radiator main body) is preferably a blackbody radiator in a viewpoint of easy manufacturing.

The blackbody radiator may be, for example, a blackbody radiator being a blackbody, a blackbody radiator formed by applying a coating to a surface of a metal material using a commercially available blackbody spray, or a blackbody radiator to which a commercially available blackbody tape is attached to a surface of a metal material.

The far-infrared radiator (radiator main body) is preferably a radiator including a multilayer film of a titania film and a silica film in a viewpoint of easily improving the $E_{8-13}/E_{5-25}$ ratio (for example, a viewpoint of easily achieving that the $E_{8-13}/E_{5-25}$ ratio is 1.20 or more).

The three-dimensional shape of the entire far-infrared radiator is not particularly limited; however, the shape is preferably a plate shape in a viewpoint of reducing the size of the device.

The shape in plan view of the entire far-infrared radiator is not particularly limited. The shape in plan view of the entire far-infrared radiator may be an elliptic shape (including a circular shape), a rectangular shape (including a square shape), or a polygonal shape other than the rectangular shape. The shape in plan view of the far-infrared radiator may be an indeterminate shape other than the above-listed shapes.

The shape in plan view of the entire far-infrared radiator is preferably an elliptic shape or more preferably a circular shape in a viewpoint of availability.

The thickness of the entire far-infrared radiator is not particularly limited.

The thickness of the entire far-infrared radiator is preferably 1 mm-30 mm, more preferably 1 mm-20 mm, or particularly preferably 2 mm-10 mm.

If the thickness of the entire far-infrared radiator is 1 mm or more, this is advantageous for the strength of the far-infrared radiator.

If the thickness of the entire far-infrared radiator is 30 mm or less, this is advantageous for saving the space in the heat insulating container.

Radiator Reflecting Layer

The far-infrared radiator may include a radiator main body, and a radiator reflecting layer that is arranged on a side of the far-infrared transmitting window member when viewed from the radiator main body and that reflects electromagnetic waves in a wavelength range of 3 μm-7 μm.

With the aspect in which the far-infrared radiator includes the radiator reflecting layer, incidence of the electromagnetic waves in the wavelength range of 3 μm-7 μm from an upper side (a direction of the far-infrared transmitting window member when viewed from the far-infrared radiator) to the radiator main body and the object can be suppressed, and hence an increase in the attainable temperature due to the incidence of the electromagnetic waves can be further suppressed.

A preferable aspect of the radiator reflecting layer is similar to a preferable aspect of a solar-ray reflecting layer (described later).

With the aspect in which the far-infrared radiator includes the radiator reflecting layer, the average reflectance $R_{3-7}$ of the far-infrared radiator being 0.05 or more is further easily achieved.

Far-Infrared Transmitting Window Member

The radiative cooling device of the present disclosure includes a far-infrared transmitting window member (for example, the above-described far-infrared transmitting window member 20) that transmits the specific far-infrared rays (that is, far-infrared rays in a wavelength range of 8 μm-13 μm).

The far-infrared transmitting window member is arranged to close at least part of the opening portion of the heat insulating container. The far-infrared transmitting window member is preferably arranged to close the entire opening portion of the heat insulating container in a viewpoint of further decreasing the attainable temperature at cooling.

The structure of the far-infrared transmitting window member may be a single-layer structure consisting of a window-member main body, or may be a multilayer structure including the window-member main body and another layer (for example, a solar-ray reflecting layer (described later)).

Average Transmittance $T_{8-13}$ in Wavelength Range of 8 μm-13 μm

The far-infrared transmitting window member has an average transmittance $T_{8-13}$ in a wavelength range of 8 μm-13 μm in a transmission direction of the specific far-infrared rays, the average transmittance $T_{8-13}$ being preferably 0.40 or more, more preferably 0.50 or more, or particularly preferably 0.60 or more. The transmission direction of the specific far-infrared rays is a direction in which the specific far-infrared rays radiated from the far-infrared radiator are dissipated to the outside from the heat insulating container via the far-infrared transmitting window member, and is, for example, a direction indicated as a traveling direction of the specific far-infrared rays 50 in FIGS. 1 and 3.

If the average transmittance $T_{8-13}$ of the far-infrared transmitting window member is 0.40 or more, the far-infrared transmitting window member more easily transmits the specific far-infrared rays radiated from the far-infrared radiator, and hence the attainable temperature at cooling can be further decreased.

The upper limit of the average transmittance $T_{8-13}$ of the far-infrared transmitting window member is not particularly limited. The average transmittance $T_{8-13}$ of the far-infrared transmitting window member is preferably 0.98 or less in a viewpoint of suitability for manufacturing of the far-infrared transmitting window member.

In this specification, when the far-infrared transmitting window member has a multilayer structure, the preferable spectral characteristics (average transmittance and solar-radiation reflectance) of the far-infrared transmitting window member represent the spectral characteristics of the entire far-infrared transmitting window member (that is, the entire multilayer structure).

In this specification, the average transmittance $T_{8-13}$ represents an arithmetic mean value of spectral transmittances for wavelengths included in a wavelength range of 8 μm-13 μm in Appendix Table 3 in JIS R 3106:1998.

The average transmittance $T_{8-13}$ is specifically obtained as follows.

First, spectral transmittances in a wavelength range of 1.7 μm-25 μm are measured by using a Fourier transform infrared spectrometer (FTIR).

Among the measurement results of the spectral transmittances in the wavelength range of 1.7 μm-25 μm, by arithmetically averaging the values (that is, 10 values) of the spectral transmittances of the respective wavelengths (the above-described 10 wavelengths) included in the wavelength range of 8 μm-13 μm in Appendix Table 3 in JIS R 3106:1998, the average transmittance $T_{8-13}$ is obtained.

$T_{8-13}/T_{5-25}$ Ratio

The far-infrared transmitting window member preferably transmits the specific far-infrared rays with priority (or ideally, selectively) in the transmission direction of the specific far-infrared rays.

More specifically, a $T_{8-13}/T_{5-25}$ ratio that is a ratio of the above-described average transmittance $T_{8-13}$ of the far-infrared transmitting window member to an average transmittance $T_{5-25}$ of the far-infrared transmitting window member in a wavelength range of 5 μm-25 μm in the transmission direction of the specific far-infrared rays is preferably 1.20 or more, more preferably 1.30 or more, or particularly preferably 1.50 or more.

If the $T_{8-13}/T_{5-25}$ ratio of the far-infrared transmitting window member is 1.20 or more, the specific far-infrared rays from the far-infrared radiator can be transmitted while heat inflow into the radiative cooling device due to heat radiation of the atmosphere (that is, heat radiation caused by electromagnetic waves with wavelengths of less than 8 μm and electromagnetic waves with wavelengths of more than 13 μm) is suppressed. Thus, the attainable temperature at cooling can be further decreased.

The upper limit of the $T_{8-13}/T_{5-25}$ ratio is not particularly limited. The upper limit of the $T_{8-13}/T_{5-25}$ ratio is preferably 2.40 or less in a viewpoint of suitability for manufacturing of the far-infrared transmitting window member.

In this specification, the average transmittance $T_{5-25}$ represents an arithmetic mean value of spectral transmittances for wavelengths included in a wavelength range of 5 μm-25 μm in Appendix Table 3 in JIS R 3106:1998.

The average transmittance $T_{5-25}$ is specifically obtained as follows.

First, spectral transmittances in a wavelength range of 1.7 μm-25 μm are measured by using a Fourier transform infrared spectrometer (FTIR).

Among the measurement results of the spectral transmittances in the wavelength range of 1.7 μm-25 μm, by arithmetically averaging values of the spectral transmittances (that is, 24 values) of the respective wavelengths (that is, the above-described 24 wavelengths) included in the wavelength range of 5 μm-25 μm in Appendix Table 3 in JIS R 3106:1998, the average transmittance $T_{5-25}$ is obtained.

Solar-Radiation Reflectance

The far-infrared transmitting window member preferably has, at a surface thereof on a side opposite from a surface thereof on a side of the far-infrared radiator, a solar-radiation reflectance of 60% or more.

If the solar-radiation reflectance of the far-infrared transmitting window member is 60% or more, incidence of solar rays (that is, electromagnetic waves in a wavelength range of 300 nm-2500 nm) into the heat insulating container can be suppressed, and hence heat inflow into the heat insulating container can be suppressed. Thus, the attainable temperature at cooling can be further decreased.

The solar-radiation reflectance of the far-infrared transmitting window member is preferably 70% or more, or more preferably 80% or more.

The upper limit of the solar-radiation reflectance of the far-infrared transmitting window member is not particularly limited. The solar-radiation reflectance of the far-infrared transmitting window member is preferably 98% or less in a viewpoint of suitability for manufacturing of the far-infrared transmitting window member.

The solar-radiation reflectance of the far-infrared transmitting window member being 60% or more can be more easily attained when the far-infrared transmitting window member includes a solar-ray reflecting layer (described later).

In this specification, the solar-radiation reflectance complies with JIS A 5759:2008, and represents a value obtained by measuring a diffused reflectance using a spectrophotometer and calculating the value based on the obtained diffused reflectance.

For the spectrophotometer, an integrating-sphere spectrophotometer may be used.

In an example (described later), for the spectrophotometer to be used for measuring the solar-radiation reflectance, a spectrophotometer V-670 (integrating-sphere spectrophotometer) manufactured by JASCO Corporation was used.

Materials and Shapes

The material of the far-infrared transmitting window member (window-member main body) is not particularly limited as long as the material can transmit the specific far-infrared rays.

The material of the far-infrared transmitting window member (window-member main body) may be a metal material or an inorganic material other than the metal material, or more specifically may be germanium (Ge, transmission wavelength: 1.8 μm-23 μm), chalcogenide (transmission wavelength: 0.75 μm-14 μm), silicon (Si, transmission wavelength: 1.2 μm-15 μm), diamond (transmission wavelength: 220 nm or more), calcium fluoride ($CaF_2$, transmission wavelength: 0.12 μm-12 μm), zinc selenide (ZnSe, transmission wavelength: 0.5 μm-22 μm), barium fluoride ($BaF_2$, transmission wavelength: 0.15 μm-15 μm), or zinc sulfide (ZnS, transmission wavelength: 0.37 μm-14 μm).

In particular, germanium, chalcogenide, or silicon is preferable among these materials.

The far-infrared transmitting window member may be treated with an antireflection coating.

The three-dimensional shape of the entire far-infrared transmitting window member is not particularly limited.

The three-dimensional shape of the far-infrared transmitting window member is preferably a plate shape in a viewpoint of easy fabrication.

The shape in plan view of the entire far-infrared transmitting window member is not particularly limited. The shape in plan view of the entire far-infrared transmitting window member may be an elliptic shape (including a circular shape), a rectangular shape (including a square shape), or a polygonal shape other than the rectangular shape. The shape in plan view of the far-infrared transmitting window member may be an indeterminate shape other than the above-listed shapes.

The thickness of the entire far-infrared transmitting window member is not particularly limited.

The thickness of the entire far-infrared transmitting window member is preferably 1 mm-30 mm, more preferably 1 mm-20 mm, or particularly preferably 2 mm-10 mm.

If the thickness is 1 mm or more, entry of electromagnetic waves other than the specific far-infrared rays into the heat insulating container can be further suppressed, and the thickness is advantageous in a viewpoint of the strength of the far-infrared transmitting window member.

If the thickness is 30 mm or less, the transmittance of the specific far-infrared rays is further improved.

Solar-Ray Reflecting Layer

The far-infrared transmitting window member may include a window-member main body, and a solar-ray reflecting layer that is arranged on a side opposite from a side of the far-infrared radiator when viewed from the window-member main body and that reflects solar rays.

With the aspect in which the far-infrared transmitting window member includes the solar-ray reflecting layer, incidence of solar rays (that is, electromagnetic waves in a wavelength range of 0.3 μm-2.5 μm) into the heat insulating container can be suppressed, and hence heat inflow into the heat insulating container can be suppressed. Thus, the attainable temperature at cooling can be further decreased.

With the aspect in which the far-infrared transmitting window member includes the solar-ray reflecting layer, the solar-radiation reflectance of the far-infrared transmitting window member being 60% or more (preferably, 70% or more, or further preferably, 80% or more) is further easily achieved.

The solar-ray reflecting layer has a function of reflecting solar rays; however, may have a function of reflecting electromagnetic waves (for example, electromagnetic waves with wavelengths being more than 2.5 μm and less than 8 μm) other than solar rays.

The structure, size, material, and so forth, of the solar-ray reflecting layer are not particularly limited, and may be appropriately selected depending on the purpose.

The structure of the solar-ray reflecting layer may be a single-layer structure or a multilayer structure.

If the structure of the solar-ray reflecting layer is a multilayer structure, the multilayer structure preferably has at least one layer selected from the group consisting of a metal layer, an inorganic layer, and an organic layer.

The structure of the solar-ray reflecting layer may include a microstructure (particles, gas cells, etc.), or may have a protruded and depressed structure at a surface thereof.

When the structure of the solar-ray reflecting layer includes a microstructure, "the microstructure" may be particles, gas cells, or the like.

The solar-ray reflecting layer is not limited to a continuous layer, and may be a particle layer consisting of particles dispersed into the window-member main body.

The solar-ray reflecting layer preferably contains particles.

The particles preferably have a number-average particle diameter of 0.1 μm-20 μm.

If the number-average particle diameter of the particles is 0.1 μm or more, a scattering cross-sectional area of the solar-ray reflecting layer for solar rays increases. Thus, the solar-radiation reflectance of the entire far-infrared transmitting window member can be increased.

If the number-average particle diameter of the particles is 20 μm or less, the scattering cross-sectional area of the solar-ray reflecting layer for the specific far-infrared rays decreases. Thus, the transmittance of the entire far-infrared transmitting window member for the specific far-infrared rays can be maintained high.

The number-average particle diameter of the particles represents a value measured as follows.

That is, the solar-ray reflecting layer is cut along a thickness direction thereof using a microtome, and a cross-sectional image with a 1000-fold magnification is acquired from the cut surface using an electron microscope S4100 (manufactured by Hitachi High-Technologies Corporation). In the acquired cross-sectional image, for each particle, it is assumed that the maximum length among segments that each connect two points in the particle is a particle length.

The measurement for the particle length is performed at 100 positions in the cross-sectional image, an average value of the 100 measurement values is obtained, and the average value serves as the number-average particle diameter of the particles.

The substance forming the particles may be, for example, a titanium oxide, a barium titanate compound, zinc sulfide, a barium oxide, a magnesium oxide, or a calcium oxide. In particular, zinc sulfide is preferable among these materials in a viewpoint of having good optical characteristics.

When the solar-ray reflecting layer contains particles, the solar-ray reflecting layer may contain resin.

Specific examples of the resin are similar to specific examples of resin in a resin layer including gas cells (described later).

The solar-ray reflecting layer is preferably a particle layer consisting of particles dispersed in the window-member main body (for example, the above-described zinc sulfide particles or titanium oxide particles) in a viewpoint that the entire far-infrared transmitting window member maintains transmissivity for the specific far-infrared rays.

If the solar-ray reflecting layer includes gas cells as a microstructure, the material of part other than gas cells may be resin.

That is, for the solar-ray reflecting layer, a solar-ray reflecting layer that is a resin layer including gas cells may be used.

The resin in the resin layer including gas cells may be polyolefin (for example, polyethylene, polypropylene, poly-4-methylpentene-1, polybutene-1, etc.), polyester (for example, polyethylene terephthalate, polyethylene naphthalate, etc.), polycarbonate, polyvinyl chloride, polyphenylene sulfide, polyethersulfone, polyethylene sulfide, polyphenylene ether, polystyrene, acrylic resin, polyamide, polyimide, or cellulose (for example, cellulose acetate).

The resin is preferably polyester or polyethylene terephthalate (hereinafter, also referred to as "PET") in a viewpoint of having good workability and good optical characteristics.

The resin layer including gas cells may include a mixture of two or more types of resin depending on the purpose.

The resin layer including gas cells may contain unavoidable impurities to a certain extent that does not affect the reflectance for solar rays.

A gas cell in the resin layer including gas cells is a space consisting of a gas and having a gas-cell length in the resin being 10 nm or more. For each gas cell, the gas-cell length is the maximum length among segments that each connect two points in the gas cell. The gas-cell length is a value measured by a method (described later).

The type of gas may be the air, or may be any type of gas other than the air, such as oxygen, nitrogen, or carbon dioxide.

The shape of the gas cell is not particularly limited, and may be any type of shape, such as a spherical shape, a columnar shape, an elliptic shape, a rectangular-parallelepiped shape (cube shape), or a prism shape.

The pressure of gas may be the atmospheric pressure, or the pressure may be increased or reduced as compared with the atmospheric pressure. The gas cells may exist separately or in a partly connected manner.

The gas cells have a number-average length of preferably 0.1 μm-20 μm.

If the number-average length of the gas cells is 0.1 μm or more, a scattering cross-sectional area of the solar-ray reflecting layer for solar rays increases. Thus, the solar-radiation reflectance of the far-infrared transmitting window member can be increased.

If the number-average length of the gas cells is 20 μm or less, the scattering cross-sectional area of the solar-ray reflecting layer for specific far-infrared rays decreases. Thus, the transmittance of the far-infrared transmitting window member for the specific far-infrared rays can be maintained high.

The number-average length of the gas cells represents a value measured as follows.

In a cross-sectional image acquired similarly to the measurement for the number-average particle diameter of the particles, for each gas cell, it is assumed that the maximum length among segments that each connect two points in the gas cell is a gas-cell length.

The measurement for the gas-cell length is performed for 100 gas cells in the cross-sectional image, an average value of the 100 measurement values is obtained, and the average value serves as the number-average length of the gas cells.

For the solar-ray reflecting layer that is the resin layer including the gas cells, a commercially available resin film may be used.

A commercially available product of the resin film may be a microcellular foamed reflector "MCPET/MCPOLYCA" manufactured by Furukawa Electric Co., Ltd., or a Lumirror (registered trademark) E20, E22, E28G, or E60 that is a white PET film manufactured by Toray Industries, Inc.

When the structure of the solar-ray reflecting layer has a protruded and depressed structure at a surface thereof, the protruded and depressed structure may have an average pitch of 100 μm or less.

Means for forming such a protruded and depressed structure may be, for example, nanoimprinting or plasma etching.

Intermediate Heat Insulating Member

The radiative cooling device of the present disclosure includes an intermediate heat insulating member between the far-infrared transmitting window member and the far-infrared radiator in the heat insulating container.

the intermediate heat insulating member thermally insulates the far-infrared transmitting window member and the far-infrared radiator from each other, and that transmits the specific far-infrared rays.

Average Transmittance $T_{8-13}$ in Wavelength Range of 8 μm-13 μm

The intermediate heat insulating member has an average transmittance $T_{8-13}$ in a wavelength range of 8 μm-13 μm in a transmission direction of the specific far-infrared rays, the average transmittance $T_{8-13}$ being preferably 0.50 or more.

The meaning of the average transmittance $T_{8-13}$ is as described above.

Even when the intermediate heat insulating member is a member that scatters the specific far-infrared rays, if the above-described average transmittance $T_{8-13}$ of the intermediate heat insulating member is 0.50 or more, the specific far-infrared rays are effectively transmitted through the intermediate heat insulating member, as energy for radiative cooling. Thus, the attainable temperature at cooling can be further decreased.

The above-described average transmittance $T_{8-13}$ of the intermediate heat insulating member is more preferably 0.60 or more, further preferably 0.70 or more, in a viewpoint of further decreasing the attainable temperature at cooling.

The upper limit of the average transmittance $T_{8-13}$ of the intermediate heat insulating member is not particularly limited. The average transmittance $T_{8-13}$ of the intermediate heat insulating member is preferably 0.98 or less in a viewpoint of suitability for manufacturing of the intermediate heat insulating member.

Solar-Radiation Reflectance

The intermediate heat insulating member preferably has, at a surface thereof on a side of a far-infrared transmitting window member, a solar-radiation reflectance of 60% or more.

If the solar-radiation reflectance of the intermediate heat insulating member is 60% or more, incidence of solar rays into the far-infrared radiator can be suppressed, and hence heat inflow into the far-infrared radiator can be suppressed. Thus, the attainable temperature at cooling can be further decreased.

The solar-radiation reflectance of the intermediate heat insulating member is preferably 70% or more, or more preferably 80% or more.

The upper limit of the solar-radiation reflectance of the intermediate heat insulating member is not particularly limited. The solar-radiation reflectance of the far-infrared transmitting window member is preferably 98% or less in a viewpoint of suitability for manufacturing of the intermediate heat insulating member.

If the solar-radiation reflectance of the far-infrared transmitting window member is 60% or more, even if the solar-radiation reflectance of the intermediate heat insulating member is less than 60%, an advantageous effect similar to the case where the solar-radiation reflectance of the intermediate heat insulating member is 60% or more can be attained.

The method of measuring the solar-radiation reflectance is as described above.

Heat Conductance

The intermediate heat insulating member has a heat conductance in the transmission direction of the specific far-infrared rays, the heat conductance being preferably 0.08 W/(m·K) or less, or more preferably 0.06 W/(m·K) or less.

If the heat conductance of the intermediate heat insulating member is 0.08 W/(m·K) or less, heat conduction from the far-infrared transmitting window member to the far-infrared radiator is further suppressed.

The lower limit of the heat conductance of the intermediate heat insulating member is not particularly limited. The above-described heat conductance of the intermediate heat insulating member is preferably 0.001 W/(m·K) or more in a viewpoint of suitability for manufacturing of the intermediate heat insulating member.

The heat conductance of the intermediate heat insulating member in the transmission direction of the specific far-infrared rays represents a value that is measured in compliance with JIS A 1412-2.

Materials and Shapes

The intermediate heat insulating member preferably contains at least one type of resin as a heat insulating material in a viewpoint of heat insulating effect.

The resin that is possibly contained in the intermediate heat insulating member is preferably at least one type selected from the group consisting of polyethylene, polypropylene, polycarbonate, polystyrene, and polynorbornene, in a viewpoint of heat insulating effect.

The resin that is possibly contained in the intermediate heat insulating member preferably includes polyethylene, or more preferably, the resin is polyethylene in a viewpoint of workability.

The intermediate heat insulating member may include a mixture of two or more types of resin depending on the purpose.

The intermediate heat insulating member may contain unavoidable impurities to a certain extent that does not affect the transmittance for the specific far-infrared rays.

The resin that is possibly contained in the intermediate heat insulating member preferably includes gas cells in a viewpoint of heat insulating effect.

If the resin includes gas cells, the heat insulating effect of the entire intermediate heat insulating member is further increased by gas cells (that is, spaces) with high heat insulating effect.

A gas cell included in the resin possibly contained in the intermediate heat insulating member is a space consisting of a gas and having a gas-cell length in the resin being 10 nm or more. For each gas cell, the gas-cell length is the maximum length among segments that each connect two points in the gas cell. The gas-cell length is a value measured by a method (described later).

The type of gas may be the air, or may be any type of gas other than the air, such as oxygen, nitrogen, or carbon dioxide.

The shape of the gas cell is not particularly limited, and may be any type of shape, such as a spherical shape, a columnar shape, an elliptic shape, a rectangular-parallelepiped shape (cube shape), or a prism shape.

The pressure of gas may be the atmospheric pressure, or the pressure may be increased or reduced as compared with the atmospheric pressure. The gas cells may exist separately or in a partly connected manner.

Void Volume of Intermediate Heat Insulating Member

If the intermediate heat insulating member contains resin including gas cells, the intermediate heat insulating member has a void volume being preferably 70% or more.

If the void volume of the intermediate heat insulating member is 70% or more, the proportion of heat conduction via the air increases among heat conduction of the entire intermediate heat insulating member, and hence the heat insulating effect of the entire intermediate heat insulating member is further increased. Regarding the reason described above, the void volume of the intermediate heat insulating member is preferably 80% or more preferably 90% or more.

The upper limit of the void volume of the intermediate heat insulating member is not particularly limited. The void volume of the intermediate heat insulating member is preferably 98% or less in a viewpoint of suitability for manufacturing of the intermediate heat insulating member.

In this specification, the void volume of the intermediate heat insulating member is a value that is measured as follows.

The intermediate heat insulating member is cut along the transmission direction of the specific far-infrared rays using a microtome, and a cross-sectional image with a 10-fold magnification is acquired from the cut surface using an optical microscope ME600L manufactured by Nikon Corporation. In the acquired cross-sectional image, an area a of part corresponding to gas cells and an area b of part corresponding to the part other than the gas cells are measured, and the void volume of an intermediate heat insulating member is obtained using an expression as follows.

$$\text{Intermediate heat insulating member void volume } (\%) = (\text{area } a / (\text{area } a + \text{area } b)) \times 100$$

For the measurement of the void volume, calculation is performed using a cross-sectional image corresponding to an actual area 500 $mm^2$ of the cross section of the intermediate heat insulating member.

Number of Gas Cells

If the intermediate heat insulating member includes gas cells, in the cross section of the intermediate heat insulating member cut along the transmission direction of the specific far-infrared rays, the number of gas cells across which a straight line in the transmission direction extends is preferably 8 or less, or more preferably 7 or less.

If the number of gas cells is 8 or less, the average transmittance $T_{8\text{-}13}$ of the intermediate heat insulating member is further easily improved, and hence the attainable temperature at cooling is further decreased.

More specifically, the refractive index of resin is in many cases about 1.5 in a far-infrared range, and hence far-infrared rays that are lost by reflection at the interface between the resin and the gas cells are about 4%. Since reflection occurs two times for one gas cell, if the number of gas cells is 8 or less, the far-infrared transmittance exceeds 50% based on calculation, and hence the attainable temperature at cooling is further decreased. The lower limit of the number of gas cells may be 1 or more, or more preferably 2 or more.

The number of gas cells represents a value measured as follows.

In a cross-sectional image acquired by a method similar to the method of measuring the void volume of the intermediate heat insulating member, a straight line is plotted in the transmission direction of the specific far-infrared rays, and the number of gas cells across which the straight line extends is measured (counted).

The above-described measurement is performed at 100 positions in the cross-sectional image, an average value of the 100 measurement values is obtained, and the average value serves as the number of gas cells.

Moreover, if the intermediate heat insulating member includes gas cells, a number-average length of the gas cells is preferably 1 mm or more. Thus, the number of scattered times and/or the number of reflected times of the specific far-infrared rays are decreased, and hence the transmittance of the specific far-infrared rays is further improved.

If the number-average length of the gas cells is 1 mm or more, the number-average length of the gas cells is more preferably 1 mm-50 mm, or further preferably 1 mm-30 mm, or particularly preferably 1 mm-20 mm.

The number-average length of the gas cells represents a value measured as follows.

In a cross-sectional image acquired by a method similar to the method of measuring the void volume of the intermediate heat insulating member, for each gas cell, it is assumed that the maximum length among segments that each connect two points in the gas cell is a gas-cell length.

The measurement for the gas-cell length is performed for 100 gas cells in the cross-sectional image, an average value of the 100 measurement values is obtained, and the average value serves as the number-average length of the gas cells.

A specific example of the intermediate heat insulating member that includes gas cells, that includes a resin as a material of part other than the gas cells, and the gas cells satisfy the above-described preferable aspect may be a gas-cell cushioning material.

A commercially available product of the gas-cell cushioning material may be Aircap (registered trademark, Sakai Chemical Industry Co., Ltd.), Putiputi (registered trademark, Kawakami Sangyo Co., Ltd.), or Minapack (registered trademark, Sakai Chemical Industry Co., Ltd.).

Moreover, if the intermediate heat insulating member includes gas cells, a number-average length of the gas cells is preferably 1 μm or less. Thus, the scattering cross-sectional area of the specific far-infrared rays is decreased, and hence the transmittance of the specific far-infrared rays is further improved.

If the number-average length of the gas cells is 1 μm or less, the number-average length of the gas cells is more preferably 0.1 μm-1 μm.

The radiative cooling device of the present disclosure may additionally include members other than the above-described members.

Examples of the other members are described below; however, the other members are not limited to the examples.

Container External Reflecting Film

The radiative cooling device of the present disclosure may include a container external reflecting film that is arranged on an outer side of at least part of an outer surface of the heat insulating container and that reflects solar rays.

With the configuration, generation of heat at the heat insulating container due to absorption of solar rays can be suppressed, and hence the radiative cooling effect by the radiative cooling device of the present disclosure can be further increased.

For the container external reflecting film, a layer similar to the above-described solar-ray reflecting layer (preferably a solar-ray reflecting layer that is a resin layer including gas cells) can be used.

Internal Far-Infrared Reflecting Film

The radiative cooling device of the present disclosure may include an internal far-infrared reflecting film that is arranged along an inner surface of the heat insulating container and that reflects far-infrared rays (electromagnetic waves in a wavelength range of 5 μm-25 μm). The internal far-infrared reflecting film may be arranged between the inner surface of the heat insulating container and a subset of the intermediate heat insulating member and the object. The internal far-infrared reflecting film may contact at least part of the inner surface of the heat insulating container or may not contact the inner surface.

In this case, "internal" of the internal heat insulating layer represents the inside of the heat insulating container.

When the radiative cooling device of the present disclosure includes the internal far-infrared reflecting film, heat radiation from the heat insulating container to the object can be suppressed. Thus, the attainable temperature at cooling can be further decreased.

The internal far-infrared reflecting film has an average reflectance $R_{5-25}$ in a wavelength range of 5 μm-25 μm the average reflectance $R_{5-25}$ being preferably 0.40 or more, more preferably 0.60 or more, or particularly preferably 0.80 or more.

In this specification, the average reflectance $R_{5-25}$ represents an arithmetic mean value of spectral reflectances for wavelengths included in a wavelength range of 5 μm-25 μm in Appendix Table 3 in JIS R 3106:1998.

The measurement method of the average reflectance $R_{5-25}$ is similar to the measurement method of the average transmittance $T_{8-13}$ except that the spectral reflectances are measured for the wavelengths included in the wavelength range of 5 μm-25 μm in Appendix Table 3 in JIS R 3106:1998 and the arithmetic mean value of the measurement results is obtained.

The material of the internal far-infrared reflecting film may be, for example, aluminum, an aluminum alloy, silver, a silver alloy, copper, or a copper alloy.

Metal Cylindrical Member

The radiative cooling device of the present disclosure may include a metal cylindrical member that is arranged on a side opposite to the opening portion of the heat insulating container when viewed from the far-infrared transmitting window member and through which the specific far-infrared rays transmitted through the far-infrared transmitting window member pass.

If the radiative cooling device of the present disclosure includes the metal cylindrical member, heat inflow into the heat insulating container due to heat radiation from a peripheral environmental member (for example, a structure, such as a building or a utility pole) can be suppressed. Thus, an increase in the attainable temperature due to the heat inflow can be further suppressed.

In this case, "cylinder" is a concept including a tapered cylinder.

The tapered cylinder is a cylinder having a shape whose diameter (outside diameter and inside diameter) increases from a side of one end toward a side of the other end in an axial direction.

Figure 2:
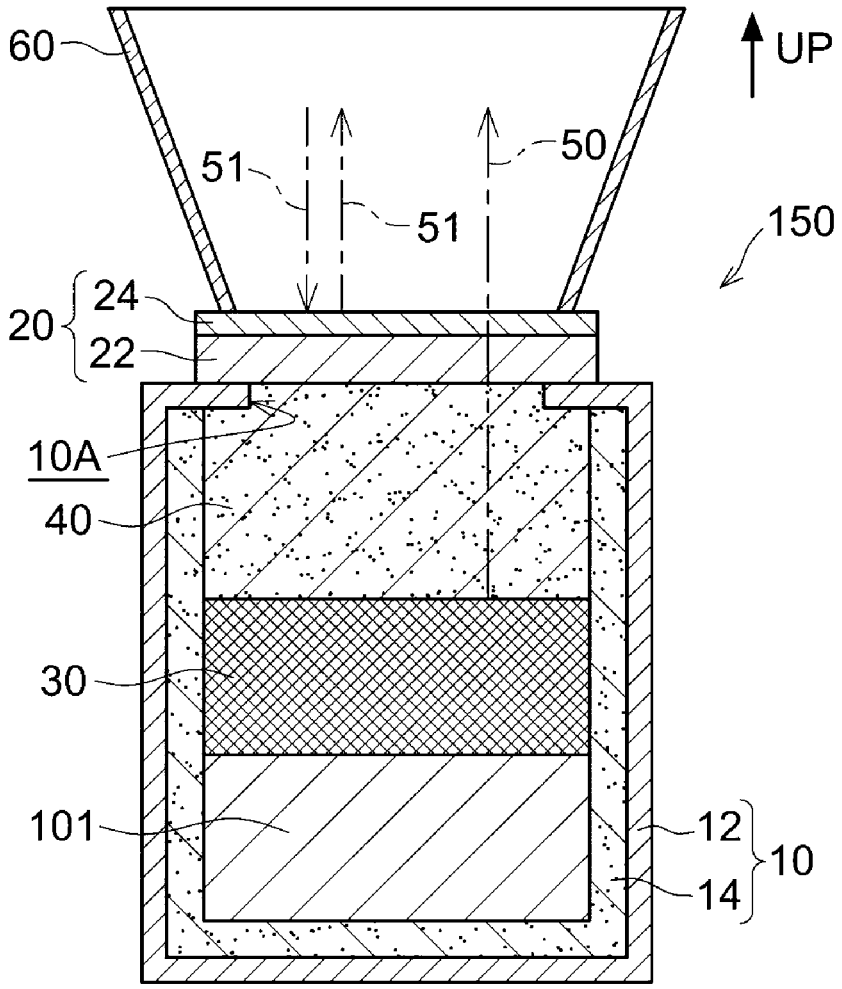
FIG. 2 is a schematic cross-sectional view conceptually showing a radiative cooling device that is another example of the radiative cooling device of the present disclosure.

FIG. 2 is a schematic cross-sectional view showing a radiative cooling device including a metal cylindrical member according to another example of the radiative cooling device of the present disclosure.

A radiative cooling device 150 shown in FIG. 2 has a structure similar to the structure of the radiative cooling device 100 shown in FIG. 1 except that the structure of the radiative cooling device 150 includes a metal cylindrical member 60.

As shown in FIG. 2, the radiative cooling device 150 includes the metal cylindrical member 60 that is arranged on a side opposite to the opening portion 10A of the heat insulating container 10 when viewed from the far-infrared transmitting window member 20.

The metal cylindrical member 60 has a tapered cylindrical shape. The tapered cylindrical shape may be, for example, a linear tapered shape, a parabolic tapered shape, or an exponential tapered shape.

The metal cylindrical member 60 is arranged such that one end thereof in an axial direction thereof contacts the far-infrared transmitting window member 20, and in a direction in which a diameter thereof increases from the one end toward the other end in the axial direction.

Furthermore, the metal cylindrical member 60 is arranged so as to include the opening portion 10A in a range surrounded by an inner peripheral surface thereof on a side of the one end of the metal cylindrical member 60 in plan view (not shown) viewed in an opening direction of the opening portion 10A.

With the radiative cooling device 150, the specific far-infrared rays 50 transmitted through the far-infrared transmitting window member 20 pass through the inside of the metal cylindrical member 60, and heat radiation from a peripheral environmental member (for example, a structure, such as a building or a utility pole) (more specifically, far-infrared rays radiated from the peripheral environment member) can be blocked using an outer peripheral surface of the metal cylindrical member 60.

Furthermore, since the metal cylindrical member 60 is arranged in the direction in which the diameter increases from the one end toward the other end in the axial direction, the effective area in which the specific far-infrared rays 50 are radiated becomes larger than the area of the opening portion 10A.

Thus, the radiative cooling device 150 can obtain better cooling performance, and hence the attainable temperature can be further decreased.

An opening area on a side of the other end (that is, at an end portion on a far side when viewed from the far-infrared transmitting window member 20) of the metal cylindrical member 60 in the axial direction is preferably 1.1 times or more, or more preferably 1.3 times or more the area of the opening portion 10A in a viewpoint of increasing the effective area in which the specific far-infrared rays 50 are radiated.

The opening area on the side of the other end of the metal cylindrical member 60 in the axial direction is preferably 6.0 times or less, or more preferably 5.0 times or less the area of the opening portion 10A in a viewpoint of effectively blocking heat radiation from the peripheral environmental member.

The material (metal) of the surface of the metal cylindrical member is preferably a metal with high reflectance for far-infrared rays. More specifically, the material is preferably aluminum, an aluminum alloy, silver, or a silver alloy.

For the metal cylindrical member, a commercially available parabolic mirror (for example, a parabolic mirror manufactured by Kokusai Shoji Co., Ltd.) may be used.

The parabolic mirror (parabolic surface mirror) is a metal cylindrical member having a parabolic tapered shape.

The size of the metal cylindrical member is not particularly limited, and may be appropriately set with regard to the purpose and so forth of the radiative cooling device.

The shapes of opening portions at both ends of the metal cylindrical member in the axial direction are preferably circular shapes.

Angle Changing Device of Metal Cylindrical Member

When the radiative cooling device of the present disclosure includes the above-described metal cylindrical member, the radiative cooling device of the present disclosure may include an angle changing device that changes an angle at which an outer opening portion of the metal cylindrical member (an end portion on a far side when viewed from the far-infrared transmitting window member) faces.

The outer opening portion of the metal cylindrical member is an opening portion at the end portion on the far side when viewed from the far-infrared transmitting window member.

The angle changing device preferably has a function of causing the outer opening portion of the metal cylindrical member to face in a direction different from the position of the sun. To attain such a function, a certain system may be appropriately selected and applied.

With the function, the angle changing device causes the outer opening portion of the metal cylindrical member to face in the direction different from the position of the sun. Thus, direct incidence of solar rays can be suppressed, and heat inflow due to the incidence can be suppressed. Accordingly, an increase in the attainable temperature can be further suppressed particularly during the daytime.

EXAMPLES

Examples of the present disclosure are described below; however, the present disclosure is not limited to the examples provided below.

Example 1

Fabrication of Radiative Cooling Device

In Example 1, a radiative cooling device shown in FIG. 3 was fabricated.

FIG. 3 is a schematic cross-sectional view conceptually showing a radiative cooling device 200 of Example 1.

Fabrication of the radiative cooling device 200 is described below with reference to FIG. 3.

First, a container 112 (container main body) made of SUS304 and having a shape provided with an opening portion 110A at an upper surface of a hollow columnar shape was prepared. The hollow columnar shape had an inside diameter of 200 mm, an outside diameter of 220 mm, and a height of 168 mm. The opening portion 110A had a diameter of 140 mm. In this case, SUS304 is one type of stainless steel.

Then, a container 116 (container main body) made of SUS304 was prepared, and 50 mL of water 201 as an object to be cooled was housed in the container 116. The container 116 had a diameter of 65 mm and a height of 40 mm, and had a cup shape.

The container 116 that houses the water 201 (that is, cooling object) was inserted into the container 112, and the gap between the container 112 and the container 116 was filled with a container heat insulating member 114. In the radiative cooling device 200, the container 112 (container main body), the container heat insulating member 114, and the container 116 (container main body) form the heat insulating container 110.

For the container heat insulating member 114, a gas cellular cushioning material (Putiputi, registered trademark, manufactured by Kawakami Sangyo Co., Ltd., trade name of d42) made of polyethylene including gas cells of a number-average length of 10 mm was used.

Then, a far-infrared radiator 130 was fabricated by applying a blackbody coating (blackbody paint JSC-3, manufactured by Japan Sensor Corporation) to a surface of a disk plate made of SUS304 and having a diameter of 70 mm and a thickness of 5 mm, and drying the coating. A heat dissipating fin 132 made of AL5052, which is one type of an aluminum alloy, was attached to one surface of the far-infrared radiator 130.

The entire opening portion of the container 116 was covered with the far-infrared radiator 130 to which the heat dissipating fin 132 was attached. At this time, the heat dissipating fin 132 was in contact with the water 201 (cooling object) in the container 116. Thus, the far-infrared radiator 130 thermally contacts the water 201 (cooling object).

Then, a space that is located in the container 112 and located above the far-infrared radiator 130 is filled with an intermediate heat insulating member 140. Then, the entire opening portion 110A of the container 112 was covered with a Ge window member 120 serving as a window-member main body of a far-infrared transmitting window member.

For the intermediate heat insulating member 140, a gas cellular cushioning material (Putiputi, registered trademark, manufactured by Kawakami Sangyo Co., Ltd., trade name of d42) made of polyethylene including gas cells of a number-average length of 10 mm was used. At this time, the intermediate heat insulating member was arranged such that, in a cross section of the intermediate heat insulating member cut along a transmission direction of the far-infrared rays, the number of gas cells across which a straight line in the transmission direction extends was 2.

For the Ge window member 120, a germanium plate with a thickness of 5 mm (manufactured by IR System Co., Ltd.) whose both surfaces were coated with DLC (diamond like carbon) was prepared.

Then, a white void film (Lumirror E60, registered trademark, manufactured by Toray Industries, Inc.) (not shown, container external reflecting film) was attached to the entire outer surface of the container 112.

Thus, the radiative cooling device 200 of Example 1 was obtained.

The spectral characteristics of the respective members were as shown in Table 1.

Respective properties of the intermediate heat insulating member were as shown in Table 1.

Evaluation on Attainable Temperature at Cooling

The radiative cooling device 200 fabricated as described above was installed outdoors at an arrangement angle at which the opening portion 110A of the heat insulating container 110 faces directly upward. For the outdoor arrangement location, a location without an object that blocks the specific far-infrared rays radiated from the far-infrared radiator 130 toward the sky was selected.

After 6 hours has elapsed since the installation, the temperature difference (° C.) expressed as follows was measured, and hence the attainable temperature at cooling was evaluated.

Temperature difference(° C.)=temperature of water 201 (that is, cooling object)(° C.) in radiative cooling device 200−outside air temperature(° C.)

The evaluation on the attainable temperature at cooling represents that the attainable temperature at cooling is lower as the temperature difference (° C.) is a negative value and the absolute value is larger. Of course, if the temperature difference (° C.) is negative, the attainable temperature at cooling is lower than that in a case where the temperature difference (° C.) is positive.

The evaluation on the attainable temperature at cooling was performed during the daytime on a fine day.

Table 1 shows the result.

Example 2

In fabrication of a radiative cooling device, the radiative cooling device was fabricated similarly to Example 1 except that a solar-ray reflecting layer consisting of zinc sulfide particles was formed on an upper surface (that is, a surface on a side in contact with the outside air) of a Ge window member 120 by dispersing zinc sulfide particles with a number-average particle diameter of 0.2 μm.

The obtained radiative cooling device was used and evaluation similar to that in Example 1 was performed.

Table 1 shows the result.

Comparative Example 1

In fabrication of a radiative cooling device, the radiative cooling device was fabricated similarly to Example 1 except that the intermediate heat insulating member 140 was not used.

The obtained radiative cooling device was used and evaluation similar to that in Example 1 was performed.

Table 1 shows the result.

TABLE 1

| | | | Example 1 | Example 2 | Comparative Example 1 |
|---|---|---|---|---|---|
| Radiative cooling device | Far-infrared transmitting window member | Average transmittance $T_{8-13}$ | 0.76 | 0.61 | 0.76 |
| | | $T_{8-13}/T_{5-25}$ ratio | 1.35 | 1.35 | 1.35 |
| | | Solar-ray reflecting layer | Not provided | Provided | Not provided |
| | | Solar-radiation reflectance | 25% | 85% | 25% |
| | Far-infrared radiator | Average emittance $E_{8-13}$ | 0.94 | 0.94 | 0.94 |
| | Intermediate heat insulating member | Average transmittance $T_{8-13}$ | 0.66 | 0.66 | No intermediate heat insulating member |
| | | Void volume (%) | 90% | 90% | |
| | | Number of gas cells across which straight line in transmission direction of specific far-infrared rays extends (number) | 2 | 2 | |
| | | Heat conductance in transmission direction of specific far-infrared rays (W/(m · K)) | 0.035 | 0.035 | |
| Evaluation results | Temperature difference (° C.) | | +5.6 | −0.2 | +6.7 |
| | Difference from Comparative Example 1 (° C.) | | −1.1 | −6.9 | — |

Regarding the evaluation for the daytime on a fine day as shown in Table 1, with the radiative cooling device of any of Examples 1 and 2 including the intermediate heat insulating member, the attainable temperature at cooling was lower than that of the radiative cooling device of Comparative Example 1 without the intermediate heat insulating member. More specifically, the attainable temperature at cooling in Example 1 was lower by 1.1° C. as compared with Comparative Example 1, and the attainable temperature at cooling in Example 2 was lower by 6.9° C. as compared with Comparative Example 1.

Comparing Examples 1 and 2 with each other, the radiative cooling device in Example 2 in which the solar-radiation reflectance of the far-infrared transmitting window member was 80% or more provided an excellent effect of decreasing the attainable temperature at cooling during the daytime.

Then, for the radiative cooling devices of Example 1 and Comparative Example 1, the above-described attainable temperatures at cooling were evaluated during the nighttime on a fine day. Consequently, the above-described temperature difference [that is, temperature difference=temperature (° C.) of water 201 (that is, cooling object) in radiative cooling device 200−outside air temperature (° C.)] of the radiative cooling device of Comparative Example 1 was −2.7° C., and the above-described temperature difference of the radiative cooling device of Example 1 was −3.0° C. That is, the attainable temperature at cooling in Example 1 was lower by 0.3° C. as compared with Comparative Example 1.

The contents of the disclosure of JP2016-194974 filed in the Japan Patent Office on Sep. 30, 2016 are incorporated in this specification by reference in its entirety.

All documents, patent applications, and technical standards described in the present specification are incorporated herein by reference to the same extent as when individual documents, patent applications, and technical standards are specifically and individually described as being incorporated herein by reference.

REFERENCE SIGNS LIST

10, 110 heat insulating container
10A, 110A opening portion
12, 112 container main body
14, 114 container heat insulating member
20 far-infrared transmitting window member
22 window-member main body
24 solar-ray reflecting layer
30, 130 far-infrared radiator

40, 140 intermediate heat insulating member
50 specific far-infrared ray
51 solar ray
60 metal cylindrical member
100, 150, 200 radiative cooling device
101 cooling object
116 container (container main body)
120 Ge window member (window-member main body)
132 heat dissipating fin
201 water (cooling object)

What is claimed is:

1. A radiative cooling device comprising:

a heat insulating container that has an opening portion, and that is configured to house an object to be cooled at an interior thereof and thermally insulates the object from an exterior thereof;

a far-infrared radiator that is arranged between the object and the opening portion in the heat insulating container, that thermally contacts the object, and that radiates far-infrared rays in a wavelength range of from 8 μm to 13 μm;

a far-infrared transmitting window member that closes at least a part of the opening portion of the heat insulating container and that transmits the far-infrared rays radiated from the far-infrared radiator; and an intermediate heat insulating member that is arranged between the far-infrared transmitting window member and the far-infrared radiator, that thermally insulates the far-infrared transmitting window member and the far-infrared radiator from each other, and that transmits the far-infrared rays radiated from the far-infrared radiator.

2. The radiative cooling device according to claim 1, wherein the far-infrared radiator has an average emittance $E_{8-13}$ in the wavelength range, in a radiation direction of the far-infrared rays, of 0.80 or more, and wherein the far-infrared transmitting window member has an average transmittance $T_{8-13}$ in the wavelength range, in a transmission direction of the far-infrared rays, of 0.40 or more.

3. The radiative cooling device according to claim 1, wherein the intermediate heat insulating member has an average transmittance $T_{8-13}$ in the wavelength range, in a transmission direction of the far-infrared rays, of 0.50 or more.

4. The radiative cooling device according to claim 1, wherein the intermediate heat insulating member contains a resin.

5. The radiative cooling device according to claim 4, wherein the resin includes gas cells.

6. The radiative cooling device according to claim 5, wherein the intermediate heat insulating member has a void volume of 70% or more.

7. The radiative cooling device according to claim 5, wherein, in a cross section of the intermediate heat insulating member cut along a transmission direction of the far-infrared rays, a number of gas cells across which a straight line in the transmission direction extends is 7 or less.

8. The radiative cooling device according to claim 4, wherein the resin is at least one selected from the group consisting of polyethylene, polypropylene, polycarbonate, polystyrene, and polynorbornene.

9. The radiative cooling device according to claim 1, wherein the intermediate heat insulating member has a heat conductance, in a transmission direction of the far-infrared rays, of 0.08 W/(mK) or less.

10. The radiative cooling device according to claim 1, wherein the far-infrared transmitting window member includes a window-member main body, and a solar-ray reflecting layer that is arranged on a side opposite from a side of the far-infrared radiator when viewed from the window-member main body and that reflects solar rays.

11. The radiative cooling device according to claim 10, wherein the solar-ray reflecting layer includes particles having a number-average particle diameter of from 0.1 μm to 20 μm.

12. The radiative cooling device according to claim 1, wherein the far-infrared transmitting window member has, at a surface thereof on a side opposite from a surface thereof on a side of the far-infrared radiator, a solar-radiation reflectance of 80% or more.

13. The radiative cooling device according to claim 1, further comprising a metal cylindrical member that is arranged on a side opposite from a side of the far-infrared radiator when viewed from the far-infrared transmitting window member and through which the far-infrared rays transmitted through the far-infrared transmitting window member pass.

14. A method of cooling an object, the method comprising disposing the object in a housing portion of the heat insulating container of the radiative cooling device according to claim 1.

* * * * *